United States Patent [19]

Poisson

[11] 4,113,000

[45] Sep. 12, 1978

[54] SELF-CLEANING EJECTOR-FILTER

[75] Inventor: Bernard Poisson, Paris, France

[73] Assignee: Regie Nationale des Usines Renault, Boulogne Billancourt, France

[21] Appl. No.: 787,514

[22] Filed: Apr. 14, 1977

[30] Foreign Application Priority Data

Apr. 14, 1976 [FR] France ..... 76 10948

[51] Int. Cl.[2] ..... B22C 17/00

[52] U.S. Cl. ..... 164/227; 55/385 R; 55/525; 210/251; 210/391; 210/494 R

[58] Field of Search ..... 210/251, 352, 356, 359, 210/391, 494, 497.1; 164/213, 227, 228, 401; 55/385 R, 525

[56] References Cited

U.S. PATENT DOCUMENTS

| | | | |
|---|---|---|---|
| 640,126 | 12/1899 | Giles | 164/213 |
| 1,175,740 | 3/1916 | Ford | 164/227 |
| 1,317,710 | 10/1919 | Koch | 164/227 X |
| 1,820,533 | 8/1931 | Foley | 210/494 |
| 2,083,148 | 6/1937 | Coulombe | 210/497.1 X |
| 2,482,321 | 9/1949 | Copeland et al. | 210/494 X |
| 2,482,330 | 9/1949 | Dudzinski | 210/494 X |

*Primary Examiner*—William A. Cuchlinski, Jr.
*Attorney, Agent, or Firm*—Oblon, Fisher, Spivak, McClelland & Maier

[57] ABSTRACT

A combination device permitting filtering of an air-sand mixture or an air-metal liquid mixture at the moment of filling a foundry mold, as well as ejection of the molded part, wherein a filtering element, composed of a spiral spring with spaces between its turns, is mounted and centered in the mold. This filtering element centers and guides an ejector, driven by an ejection striker plate. In the process of ejection, the elongation of the spring widens the spaces between its turns, thus freeing bits of sand or metal caught between the turns, to provide self-cleaning. The device can be used in foundries to make mold cores and to mold light-alloy parts by gravity or low pressure in metal molds.

7 Claims, 9 Drawing Figures

SELF-CLEANING EJECTOR-FILTER

BACKGROUND OF THE INVENTION

1. Field of the Invention

The present invention relates to a device combining ejection and self-cleaning filtration which is used as equipment for filtering air and ejection in molds for making mold cores blown in hot or cold boxes, as well as those for casting light-alloy parts by gravity or low pressure in metal molds.

2. Description of the Prior Art

For this type of equipment, two different devices are generally used, the first being a filtering element for letting the air escape at the moment of filling the mold. This filtering element is usually in the form of a porous or fritted plate, or one penetrated by a large number of holes or slits.

The second device is an ejector element consisting of a pusher guided in the mold and driven by an ejector device.

Among the drawbacks of the known devices are the multiplication of the filter-ejector elements and the difficulty in fabricating the filtering elements. Further, the slits or holes of the porous plate have a width or diameter of only some tenths of a mm (0.05 to 0.2), and therefore very rapid fouling of the slits or holes occurs, leading to a rapid decrease in the filtering area. In addition, guiding of the ejection elements is made difficult by the presence of sand and the mold temperature, and accordingly rapid deterioration of the molds takes place around the guides.

SUMMARY OF THE INVENTION

The object of the present invention is to provide a filtering and ejection device avoiding the foregoing drawbacks and attained essentially by the provision of an elastic filtering element made from a spring forming a flat spiral with non-touching turns flush with the mold surface and having, at its center, an ejection element situated in the orifice closed by the spring-filter and the end of which is flush with the surface of the filter.

This combined device permits the filtering of an air-sand mixture or an air-liquid metal mixture at the moment of filling a mold, as well as the ejection of the casting. The filtering element is thus realized by a spiral spring with non-touching turns obstructing the entrance of an air-evacuation orifice and having an axial and a radial elasticity. The spiral spring surrounds the end of the ejection element situated in the air-evacuation orifice.

The spiral spring surrounds the ejection element, the ejection element supporting the spiral spring at its center. This spiral spring as well as the ejection element, can be mounted in a mold. The non-touching turns of the spiral spring assures the filtering of an air-sand or air-liquid metal mixture. The radially elasticity of the spiral spring assures the centering of the ejection element and the axial elasticity of the spiral spring allows displacement of the ejection element, which is held centered on its longitudinal axis, such that the displacement of the ejection element causes elongation of the spiral spring. This elongation of the spiral spring increases the spacing of the turns, which releases the elements (sand or metal) trapped between them, thus providing a self-cleaning action. The return of the ejection element to its initial position is further assured by the spiral spring.

The device is characterized by the fact that the spiral spring has turns of a cross section forming a plane face coinciding with the mold surface on the side next to the piece being cast, the cross section of the turns constantly decreasing in width with increasing distance from the mold surface. The spiral spring further is held between an outer cylindrical casing for centering the filter-ejector in the mold and an inner concentric cylindrical casing receiving the ejector, such assembly of the spiral spring and the two cylindrical casings being made, according to one embodiment, in one piece by injection molding of plastic material. On the other hand, the assembly of the spiral spring and the two cylindrical casings can be made in one metal piece by electrochemical etching of the spiral spring in a metallic sheet initially joining the two cylindrical casings.

The device is further characterized by the fact that the filter-ejector element can be made in one piece starting with a forged blank in which the internal shape between the concentric cylindrical casings is realized with a stamp which impresses the contour of the spiral spring on the surface of the plate connecting the two cylindrical casings, the spring being obtained by a flat machining of the opposite surface so that the spiral groove made by the stamp emerges on the machined surface.

The outer centering casing has a supporting flange extending towards the center, against which flange the inner casing receiving the ejector is stopped in retraction. Also, the ejector slides, over part of its travel in ejection, within the inner centering cylindrical casing before driving the latter, together with the spiral spring, by a shoulder over the remainder of its travel in ejection.

Such an arrangement is particularly advantageous in that it permits:

a) combining in the same place two main functions, namely, filtration and ejection;

b) a systematic cleaning of the filtering element by the successive opening and closing of the spaces between the turns of the spiral spring with each movement of the ejector;

c) an axial elasticity assuring the return of the ejector element;

d) a radial elasticity assuring guidance of the ejector element without risk of binding; and e) an easy realization of the filtering element (wound wire) permitting the utilization of materials of very high mechanical qualities (extra-hard steel, inox, etc.).

BRIEF DESCRIPTION OF THE DRAWINGS

Various other objects, features and attendant advantages of the present invention will be more fully appreciated from the following detailed description of several forms of realization of the self-cleaning filter-ejector device of the present invention which are described below, by way of example, and with reference to the attached drawing, in which.

DETAILED DESCRIPTION OF THE PREFERRED EMBODIMENTS

Figure 1:
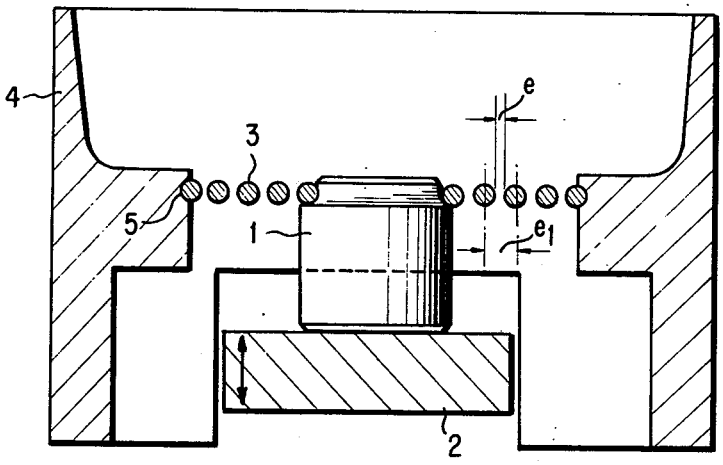
FIG. 1 is a view in axial cross section of the device used in a mold for the blowing of mold cores.

Referring then to FIG. 1, the device shown therein comprises an ejection element 1 driven by an ejection striker plate 2. A filtering element 3, being a wire wound in a flat spiral, with turns spaced apart by an amount *e*, is held in a mold 4 by means of a groove 5.

In the position shown in FIG. 1, which corresponds to the forming phase of the core or the casting of a part, the tightness of the spiral 3 is such that it can let the air escape from the mold through the slits of width *e* and length equal to that of the unwound spiral but hold back the sand or liquid metal which solidifies immediately, the ejection element 1 supported on the ejection striker plate 2 opposing any sag in the spiral.

Figure 1A:
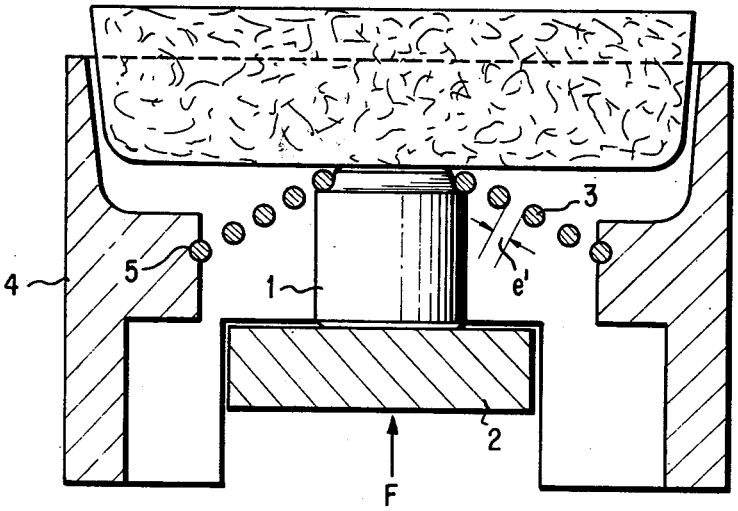
FIG. 1*a* shows the same device as shown in FIG. 1 in the ejection position.

In the position shown in FIG. 1*a*, which corresponds to the ejection and filter-cleaning phase, the ejector 1 driven by the plate 2 ejects the part. The spiral 3, driven by the ejector 1, is deformed and elongated so that the width *e'* of the slit is increased, the effect of which is to release grains of sand or particles of metal caught in the slit.

Furthermore, the rapid increase in the width "*e*" of the slit, made possible by the use of a wire of suitable profile, facilitates the removal of wedged particles of dimension *e* less than *e*1 (see FIG. 1).

As the ejection striker plate 2 comes back down, the axial spring effect of the spiral tends to return the ejector to its initial position. This feature permits elimination of the rigid connection, or of an ejector/ejection striker plate, and thus an important simplification.

As the ejector moves up or down, the radial spring effect of the spiral constantly centers the ejector on its axis, thus making a guide for the ejector in the mold unnecessary.

Figure 5A:
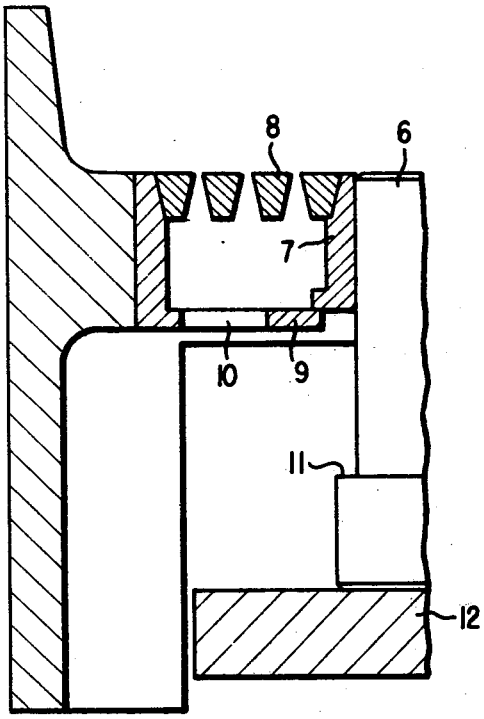
FIG. 5 is a montage of the device in which the length of travel for ejection is greater than that for cleaning.
Figure 5B:
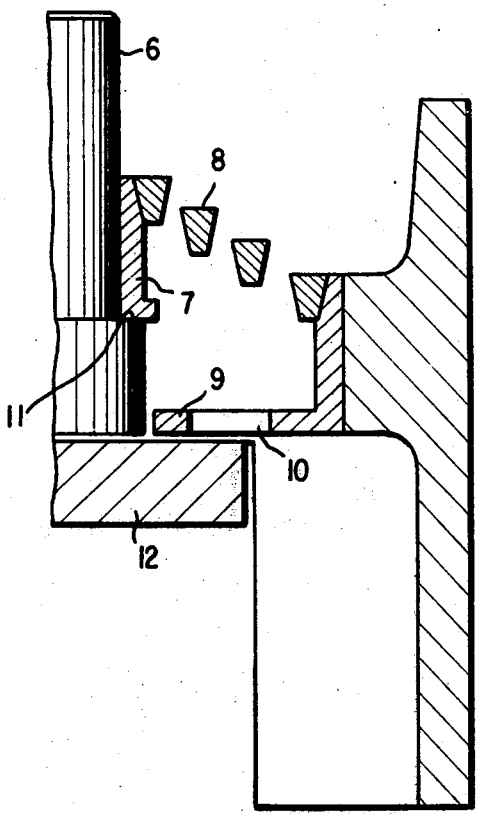

FIGS. 5A and 5B illustrate a variant of the general arrangement of FIG. 1A and 1B. It is the one to use when it is desired to have the length of travel for ejection longer than that for cleaning.

In the position shown in FIG. 5A, corresponding to the forming phase of the core or the casting of a part, the central portion 7 of the spiral 8 is supported by a piece 9 with large holes 10 so as not to decrease the filtering area of the spiral.

In the position shown in FIG. 5B, corresponding to the end of ejection, the ejector 6 which was able to slide freely in the central portion 7 of the spiral during the first part of its travel, carries the spiral with it to the end of its travel by reason of a shoulder 11 on the ejector 6, thus providing the displacement for cleaning. The length of travel for cleaning is limited by the piece 9 against which the ejection striker plate 12 comes to rest.

Figure 2A:
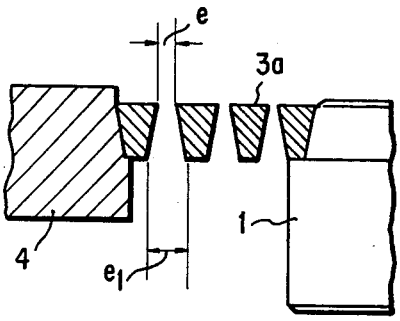
FIGS. 2*a*, 2*b* and 2*c* show some examples of possible spiral wire profiles with which one can realize the spiral spring as a function of the desired resistance to sagging compatible with the most rapid possible increase in the width of the gap from *e* to *e*1.
Figure 2B:
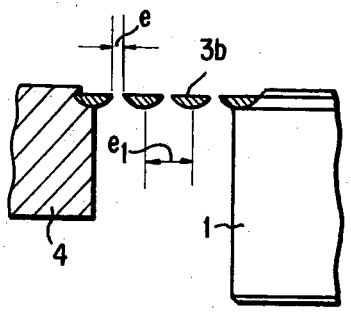
Figure 2C:
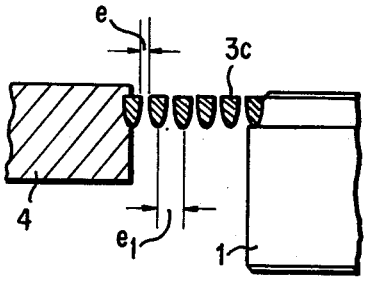

Depending on the type of application, the retraction forces necessary and the pressures which the spiral spring 3 must resist, one may choose, for the latter, a relatively massive trapezoidal profile 3*a*, as indicated in FIG. 2*a*. This shape is suited to the thermal and mechanical demands of casting under pressure. Thinner sections like 3*b* and 3*c* (FIGS. 2B and 2C) are better suited to filter-ejector applications in core molds.

Figure 3:
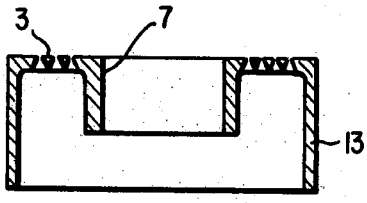
FIG. 3 indicates the way in which a filter-ejector conforming to the invention can be realized in one piece by molding, a plastic material, for example, or by machining, electro-etching for instance.

FIG. 3 shows an example of such a filter ejector of the type with an inner sleeve 7 and an outer cylindrical casing 13, as illustrated in composite in FIG. 5, but this time made in one piece by molding under pressure, using plastic for instance. This mode of realization is particularly suited to rather large sections of the filter spiral 3. For thinner sections which would be hard to mold, the spiral spring may be placed in the injection mold as an insert to effect its assembly between the two casings 7 and 13.

Figure 4:
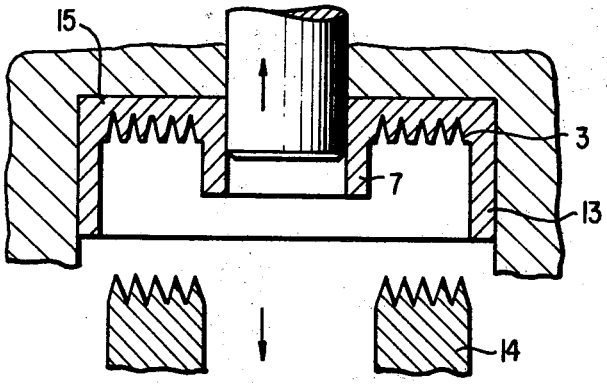
FIG. 4 shows the way in which a filter-ejector conforming to the invention can be realized in a single metallic piece from a machined forging.

FIG. 4 shows an example of monobloc construction in metal, e.g. brass, by cold extrusion and machining. Starting with a blank in the form of a washer, with the diameter of the inner and outer casings 7 and 13, a stamp 14 forms the casings 7 and 13 by inverse extrusion and impresses on the bottom of the extrusion the shape of the spiral 3. Machining away the excess thickness of metal 15 frees the turns of the spiral and completes the formation of the filter-ejector. This technique is a good one for mass production.

Obviously many modifications and variations of the present invention are possible in light of the above teachings. It is therefore to be understood that within the scope of the appended claims, the invention may be practiced otherwise than as specifically described herein.

I claim:

1. A combination device for filtering the air from an air-sand mixture or an air-liquid metal mixture in molds for sand cores and metal castings at the moment of filling these molds, as well as for ejecting the finished part, comprising:

a filtering element in the form of a spiral spring, the turns of which are non-touching, for obstructing an air-evacuation orifice, an ejector element situated in said orifice such that the central part of the spiral spring is wrapped around an end of said ejector element so as to support said spiral spring and to oppose any sag in the spiral spring; and, means for moving said ejector element in an upward and downward direction.

2. A device as set forth in claim 1, wherein said spiral spring connects an outer cylindrical casing centering the filter-ejector in the mold to a concentric inner casing receiving the ejector.

3. A device as set forth in claim 2, wherein the assembly consisting of the spiral spring and the two cylindrical casings comprises a one piece member.

4. A device as set forth in claim 2, wherein the assembly consisting of the spiral spring and the two cylindrical casings comprises a one metal piece made by electrochemical etching of the spiral in a metal sheet already joining the two cylindrical casings together.

5. A device as set forth in claim 2, wherein the filter-ejector element is a one piece member made by starting with a forged blank in which the internal shape between the concentric cylindrical casings is obtained by means of a stamp which impresses the contour of the spiral spring on the surface of the bottom plate joining the two cylindrical casings, the spring being obtained by flat machining of the opposite surface until the spiral groove impressed by the stamp is exposed.

6. A device as set forth in claim 1, wherein:

said mold further comprises a groove for holding said filtering element.

7. A combination device for filtering the air from an air-sand mixture or an air-liquid metal mixture in molds for sand cores and metal castings at the moment of filling these molds, as well as for ejecting the finished part, comprising:

a filtering element in the form of a spiral spring, the turns of which are non-touching, for obstructing an air-evacuation orifice;

an ejector element situated in said orifice wherein said spiral spring has turns of a cross section forming a plane face flush with the surface of the mold on the side next to the part being molded, the cross section of the turns being of constantly decreasing width in the direction away from said surface.

* * * * *